US008037920B2

(12) United States Patent
Svirsky et al.

(10) Patent No.: US 8,037,920 B2
(45) Date of Patent: Oct. 18, 2011

(54) RETRACTABLE RIGID AWNING AND OPERATING MECHANISM THEREFOR

(76) Inventors: Alexander Svirsky, Aurora, CO (US); Vladimir Svirsky, Aurora, CO (US)

( * ) Notice: Subject to any disclaimer, the term of this patent is extended or adjusted under 35 U.S.C. 154(b) by 173 days.

(21) Appl. No.: 12/416,903

(22) Filed: Apr. 1, 2009

(65) Prior Publication Data

US 2010/0252208 A1 Oct. 7, 2010

(51) Int. Cl.
*E04F 10/10* (2006.01)

(52) U.S. Cl. ..... 160/62; 160/132; 160/352; 160/57; 160/188

(58) Field of Classification Search ..... 160/62, 160/56, 57, 81, 224, 54, 222, 202, 188, 132; 49/198, 203, 204, 138, 101, 105, 106, 97, 49/107, 108; 187/334, 324, 333; 74/89.27, 74/89.26, 424.72, 424.7
See application file for complete search history.

(56) References Cited

U.S. PATENT DOCUMENTS 1,627,975 A * 5/1927 Kempton et al. ..... 296/95.1
1,682,254 A * 8/1928 Rorabacher ..... 49/27
1,790,648 A * 2/1931 Bancroft ..... 160/117
1,934,590 A * 11/1933 Ellis, Jr. et al. ..... 187/316
2,053,172 A * 9/1936 Young ..... 49/103
2,106,926 A * 2/1938 Hammell ..... 187/280
2,814,483 A * 11/1957 Bentley ..... 49/97
2,856,996 A * 10/1958 Gamache ..... 160/132
3,845,591 A * 11/1974 Stine ..... 52/67
5,634,376 A * 6/1997 Kitamura ..... 74/490.03
2004/0123694 A1 * 7/2004 Negri ..... 74/490.01

* cited by examiner

*Primary Examiner* — Blair M. Johnson
(74) *Attorney, Agent, or Firm* — Alexander R. Svirsky

(57) ABSTRACT

A retractable rigid window awning includes a number of U-shaped panels pivotally attached to a building on the sides of a window. In the retracted position, the panels are disposed above the window, in tiers. Each panel has a pair of actuators that enable its extension and retraction. Each actuator is attached to the panel at one end and to a movable nut at the other end via articulated joints. The nuts are installed on a driving screw attached to the building. The awning is extended by rotating the screw, which causes the nuts to travel along the screw. The actuators push their respective panels out and tilt them down. Depending on the length of actuators, panels travel different distances from the building creating a continuous shade over the window. The awning is retracted by rotating the screw in the opposite direction.

5 Claims, 4 Drawing Sheets

RETRACTABLE RIGID AWNING AND OPERATING MECHANISM THEREFOR

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to rigid awnings that usually are installed over windows.

Awnings have been used for centuries to enhance aesthetic appeal of building exteriors and protect building interiors from excessive gain of solar heat through windows. Shading windows with awnings is one of the known methods of increasing energy efficiency of buildings. By lowering temperature inside the building during air conditioning seasons, awnings create savings in cooling energy and also may help lower cost of mechanical cooling equipment. These benefits of awnings are described in a report "Awnings in Residential Buildings" that was initiated by the Professional Awning Manufacturers Association (PAMA) and issued in September 2007 by the Center for Sustainable Building Research of the University of Minnesota with participation by the Windows and Glazings Program at Lawrence Berkeley National Laboratory (LBNL). It is obvious that the same benefits are available for commercial and industrial buildings.

The same report notes that because awnings block desirable passive gain of solar heat during the heating season, the highest energy savings are achieved if awnings are kept in place in summer and removed or retracted in winter.

It is also advisable to remove or retract awnings in anticipation of high wind or storm conditions to reduce the load on and avoid possible destruction of the awnings and the associated building.

Because removing awnings for the winter season or before a storm is difficult and inconvenient, it is desirable to use retractable awnings. Such awnings are well known in the industry and usually are made of fabric. A retractable fabric awning is retracted by rolling the fabric up onto a roller rotatably attached to the building.

Even though retractable fabric awnings have been in use for decades, they are not sufficiently durable, as they require periodic replacement of the fabric; they are not able to withstand high winds or any significant snow or ice load.

The prior art also includes retractable or adjustable rigid awnings. One of such adjustable awnings is described in U.S. Pat. No. 2,791,009 to Wagner. It is a louver type awning where louvers are operated by a link mechanism. Among the disadvantages of such awning is the existence of an excessive number of movable parts subject to weather elements, which makes it prone to malfunction. Also, such awning cannot be retracted for the winter season and therefore inevitably creates shade when it is not needed. A collapsible rigid awning is described in U.S. Pat. No. 6,202,363 to Chang. It may be collapsed when shade is not required, however its operating mechanism is complicated, consisting of many movable parts subject to weather elements, and also is prone to malfunction. In addition, such awning does not lend itself to being used in any intermediate position between the fully extended and fully collapsed positions. Furthermore, when in the collapsed position, it requires additional space width-wise approximately equal to the length of its panels. Another type of retractable rigid awnings is available on the market in the form of roll-up awnings. Such awning consists of narrow aluminum strips connected to each other with ropes or bands and is retracted by rolling these strips up onto a roller, similar to fabric retractable awnings. This design does not allow for any side panels that may be desired, has many small movable parts and requires constant tension to be applied to the connecting ropes or bands to maintain the awning in a taut condition, which reduces the awning's durability.

BRIEF SUMMARY OF THE INVENTION

The present invention provides a retractable rigid awning for mounting over windows. The awning includes two or more U-shaped movable rigid panels pivotally attached to a building on the sides of a window. In the retracted position, panels are disposed above the window, substantially perpendicularly to the building wall, in a tiered relationship with each other. Each panel has a pair of actuators that enable the panel's extension and retraction. The upper end of each actuator is attached to the panel via an articulated joint. The lower ends of each pair of actuators are attached to a pair of nuts via articulated joints. The nuts in each pair are installed on opposite sides of a screw that is rotatably attached to the building. To bring the awning into an extended position, the screw is rotated, which causes the nuts and the lower ends of the actuators to travel along the screw. The two nuts is each pair travel in opposite directions. As a result, the angle between the actuator and the building increases, each panel is pushed outwardly from the building and tilts down around its pivots. To return the awning into the retracted position, the screw is rotated in the opposite direction.

An object of the present invention is to provide a rigid retractable awning that is aesthetically pleasing, durable, requires little maintenance and is able to withstand high winds and sufficient snow and ice load.

Another object of the present invention is to provide a rigid retractable awning that has a simple design and a limited number of movable parts.

A further object of the present invention is to provide a rigid retractable awning that may be used in any intermediate position.

A further object of the present invention is to provide a rigid retractable awning that may be easily operated manually or by power.

A further object of the present invention is to provide an operating mechanism allowing extension and retraction of individual panels in a synchronized manner.

BRIEF DESCRIPTION OF THE DRAWINGS

Other advantages of the present invention will be apparent to those skilled in the art from the following description of its embodiments with reference to the accompanying drawings wherein.

DETAILED DESCRIPTION OF THE INVENTION

Figure 1:
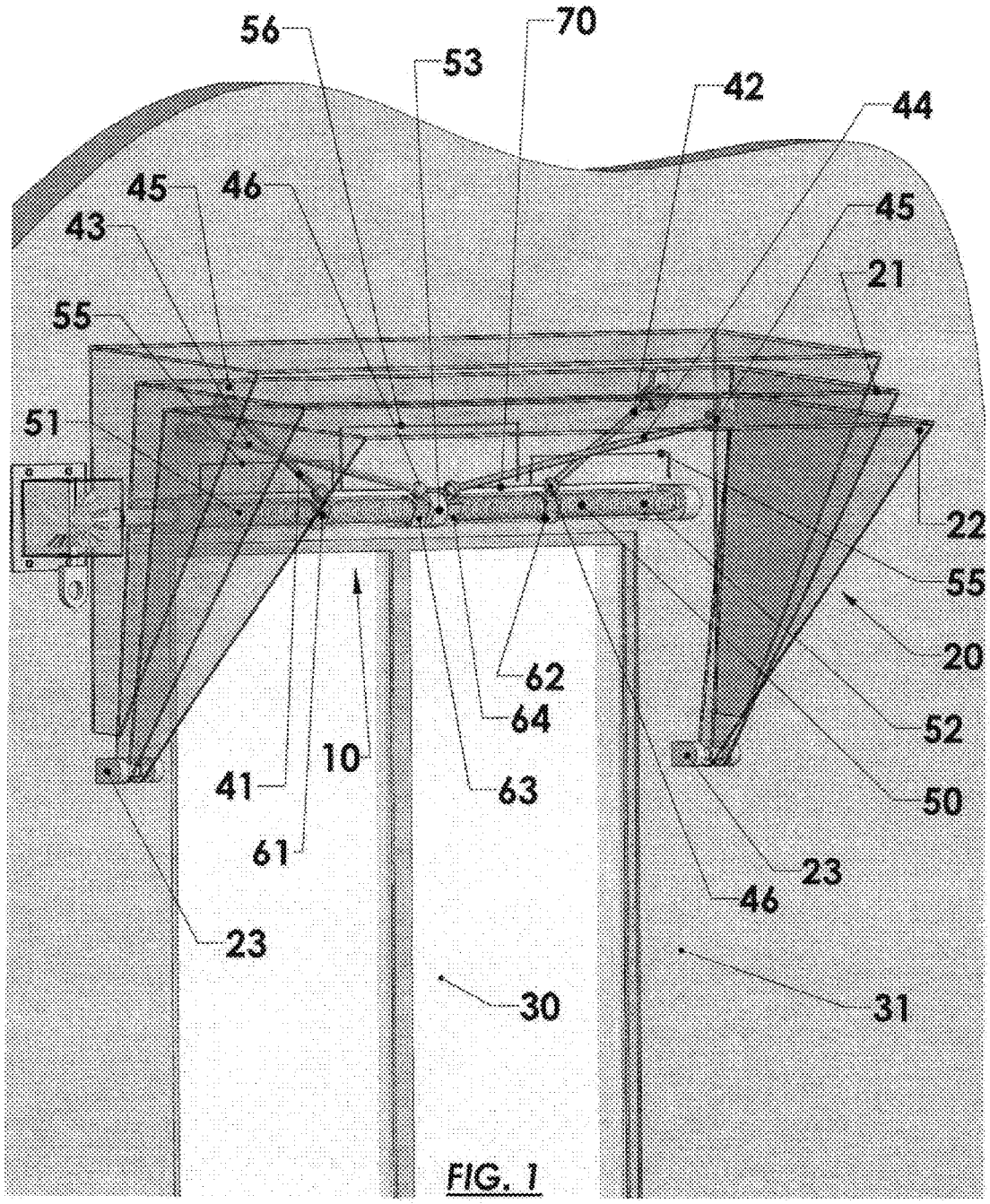
FIG. 1 is a perspective view of a rigid retractable awning constructed in accordance with the present invention in the fully retracted position.

Referring to the drawings, in particular to FIG. 1, where a rigid retractable awning constructed in accordance with the present invention is shown in a retracted position and is generally designated by a numeral 10, the awning includes a plurality of panels 20. The panels 20 are shown transparent for convenience of illustration only. For the purposes of this description and clarity of the drawings, the awning includes an upper panel 21 and a lower panel 22, however, it is understood that the awning may include a greater number of such panels without departure from the concepts of the present invention. In the fully retracted position shown in FIG. 1, the panels 20 are disposed above the window 30, substantially perpendicularly to the building wall, at a slope sufficient for draining water, in a tiered relationship with each other. Each panel 20 is pivotally attached to the building 31 on both sides of the window via pivots 23. The panels 20 may be lowered, or extended, to create a shade over the window 30, and raised, or retracted, when shade is not required. To effect extension and retraction of the awning, the upper panel 21 is equipped with a pair of actuators 41 and 42, and the lower panel 22 is equipped with a pair of actuators 43 and 44.

Figure 2:
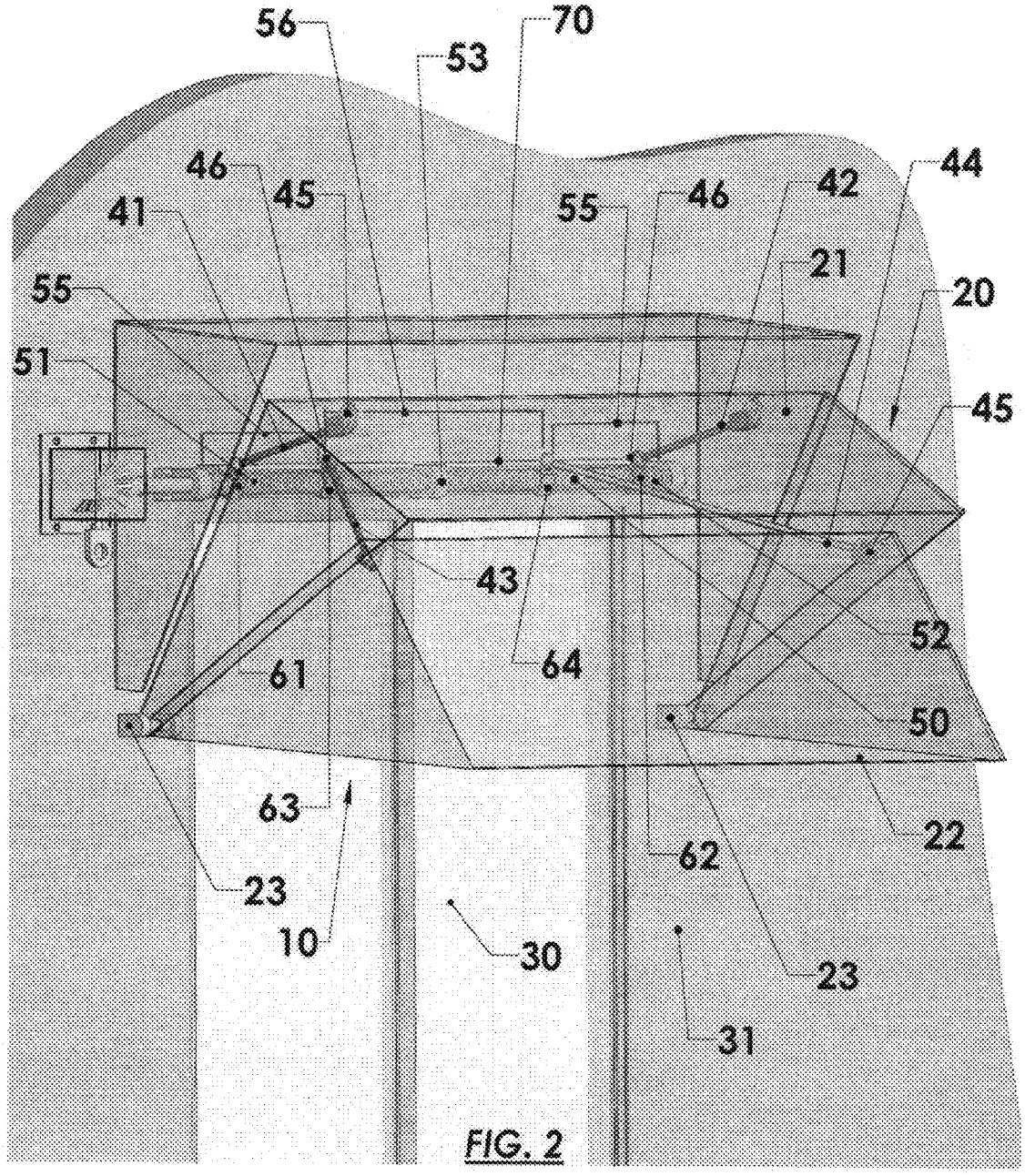
FIG. 2 is a perspective view of the awning in an extended position.

In the preferred embodiment of the present invention shown in FIGS. 1 and 2, each of the actuators 41 through 44 is attached to its respective panel 20 by means of an articulated upper joint 45, for example a universal joint or a ball-and-socket joint. Each of the actuators 41 through 44 is attached by means of an articulated lower joint 46 to its respective nut of the set of nuts numbered 61 through 64. The nuts 61-64 are movably installed on a driving screw 50 that is rotatably attached to the building 31. The driving screw 50 has a left side 51 and a right side 52 that have threads of opposing directions, for example the left side 51 has a left-hand thread and the right side 52 has a right-hand thread, or vice versa. The actuators 41 and 42 of the upper panel 21 are attached, respectively, to distant nuts 61 and 62, the actuators 43 and 44 of the lower panel 22 are attached, respectively, to close-in nuts 63 and 64. The distant nuts 61 and 62 are disposed farther from the driving screw center 53 than the close-in nuts 63 and 64.

To lower the panels 20 from a retracted position shown in FIG. 1 and bring them down into an extended position shown in FIG. 2, the driving screw 50 is rotated manually or by power, for example by an electric motor that is readily available on the market, in the appropriate direction to cause all of the nuts 61-64 to move simultaneously outwardly from the driving screw center 53. A guide 70 is provided to prevent the nuts 61-64 from rotating as they move along the driving screw 50. As a result of such rotation of the driving screw 50 and the corresponding movement of the nuts 61-64, all the lower joints 46 of the actuators 41-44 move outwardly from the driving screw center 53, which causes the angle between each of the actuators 41-44 and the building to increase and each of the panels 20 to be pushed outwardly from the building 31 and tilt down around its pivots 23. The actuators 43 and 44 of the lower panel 22 being longer that the actuators 41 and 42 of the upper panel 21, the equal amount of travel of the pair of nuts 63 and 64 and the pair of nuts 61 and 62 along the driving screw 50 results in the lower panel 22 tilting farther from the building 31 than the upper panel 21. This differential travel of the individual panels 21 and 22 creates an extended awning that forms a continuous shade over the window 30. To return the awning 10 into the retracted position, the driving screw 50 is rotated in the opposite direction. The awning may be stopped and used in any intermediate position between the fully extended position shown in FIG. 2 and the fully retracted position shown in FIG. 1.

It may become necessary for practical purposes to achieve a different travel distance of the pair of nuts 61 and 62 connected to the upper panel 21 compared with the travel distance of the pair of nuts 63 and 64 connected to the lower panel 22. In this situation, the sections 55 of the driving screw 50 where the nuts 61 and 62 travel between the retracted position shown in FIG. 1 and the extended position shown in FIG. 2 may be made with a pitch of thread that is different from the sections 56 where the nuts 63 and 64 travel between their respective retracted and extended positions.

Figure 3:
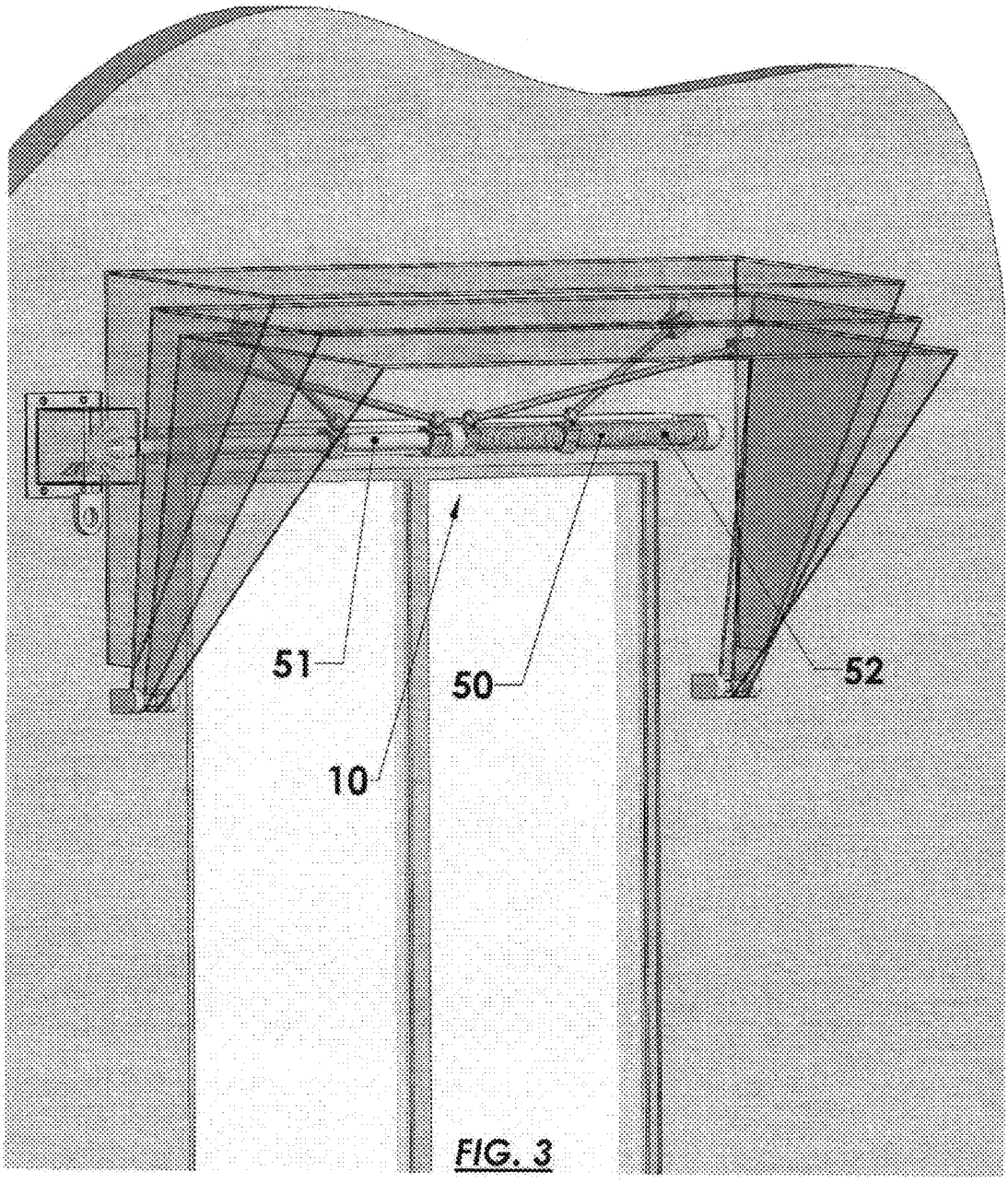
FIG. 3 a perspective view of a second embodiment of the present invention where one side of the screw is not threaded.
Figure 4:
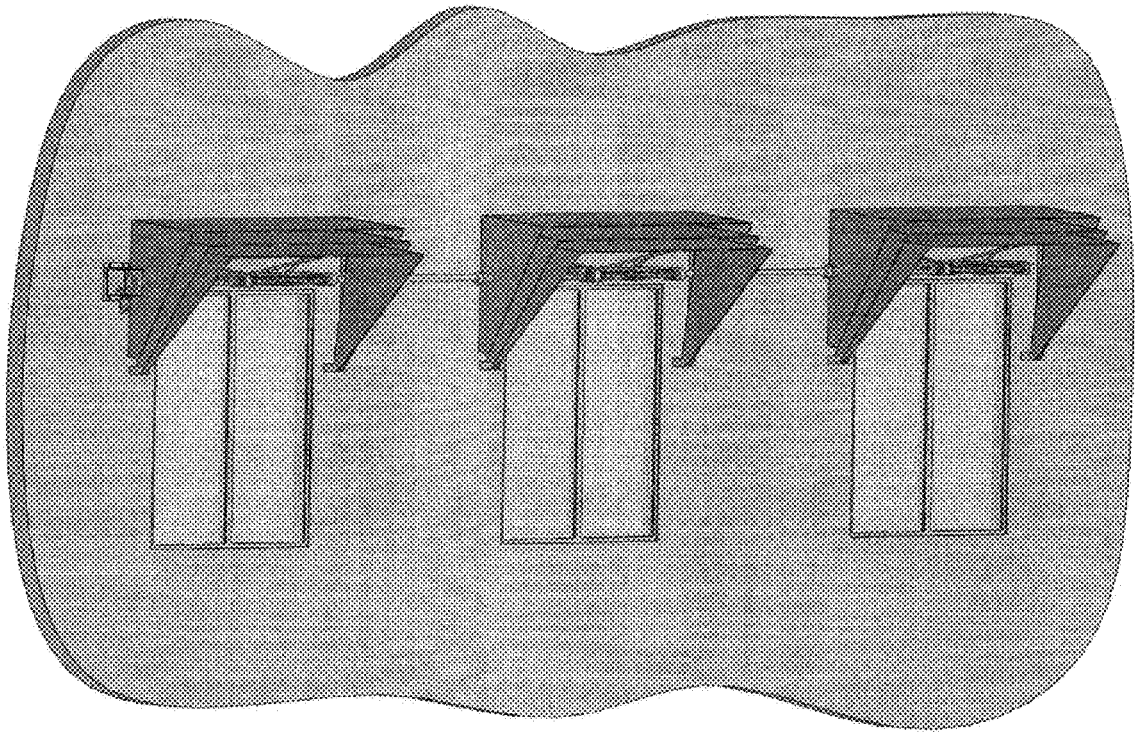
FIG. 4 is a perspective view of a series of awnings of the present invention installed on several windows and connected to be operated simultaneously.

A second embodiment of the awning 10, where the left side 51 of the screw 50 is not threaded is shown in FIG. 3. It operates in the same manner as the preferred embodiment shown in FIGS. 1 and 2, except the screw 50 does not engage the nuts installed on the left side 51 and forms a sliding connection with such nuts. In this embodiment, the nuts installed on the left side 51 are driven by their respective actuators, which in turn are driven by their respective panels.

It will be understood that the invention is not restricted to the embodiments described and illustrated above. The panels 20 may be curved to create a more pleasing appearance if desired and may be equipped with arms instead of solid side sections if shading on the sides is not desired. The rotation of the driving screw 50 may be effected manually either from the outside or from inside of the building by using simple transfer mechanisms that are well known in the industry. The driving screw 50 may be rotated by using a remotely controlled electric motor, also well known in the industry. Such electric motor may be controlled by a light and/or heat and/or wind sensor to extend and retract the awning depending on weather conditions. The upper ends of the actuators 41-44 may be attached to the center of their respective panels 21 and 22 instead of panel's ends as illustrated, and each of the panels 20 may be driven by just one actuator, rather than a pair of actuators. Any such modifications will remain within the scope of the present invention.

The invention claimed is:

1. A retractable awning for mounting to a building, said awning comprising:

one or more panels disposed, in a retracted position, in proximity to said building and pivotally attached to said building;

a panel operating mechanism comprising one or more actuators, each of said panels being driven by at least one of said actuators disposed at an angle to said building, an upper end of each of said actuators being attached via an articulated joint to one of said panels and a lower end of each of said actuators being attached via an articulated joint to a nut, each of said nuts being movably installed on a driving screw, said driving screw being rotatably attached to said building, whereby said awning is brought into an extended position by rotating said driving screw, which rotation causes said nuts to move along said driving screw causing said angle to increase and each panel to be pushed outwardly from said building and tilt down, and is brought back into a retracted position by rotating said driving screw in an opposite direction.

2. A retractable awning of claim 1, wherein said driving screw comprises a left side and a right side having threads of opposing directions, each of said panels is attached to a pair of said actuators attached to a pair of nuts, said pair of nuts being installed on said left side and right side of said driving screw, whereby rotating said driving screw causes said nuts to move along said driving screw in opposite directions.

3. A retractable awning of claim 1, wherein said driving screw comprises a left side and a right side, one of said sides forming a threaded connection with its respective nuts and other side forming a sliding connection with its respective nuts, each of said panels is attached to a pair of said actuators attached to a pair of nuts, said pair of nuts being installed on said left side and right side of said driving screw.

4. A differential movement mechanism comprising:

a plurality of driven elements;

a plurality of actuators, each of said elements being driven by a pair of said actuators, one end of each of said actuators being connected to one of said elements;

a plurality of nuts, the other ends of each pair of said actuators being connected to a pair of said nuts;

a rotatable driving screw comprising a left side and a right side having threads of opposing directions, each pair of said nuts being movably installed on said left side and right side of said driving screw, said actuators being disposed at an angle relative to said driving screw, said actuators connected to elements to be driven a greater distance being longer and actuators connected to elements to be driven a shorter distance being shorter, whereby rotation of said driving screw causes each pair of said nuts to move along said driving screw in opposite directions causing said angle to change and causing elements connected to said longer actuators to travel a greater distance than elements connected to said shorter actuators.

5. A differential movement mechanism comprising:

a plurality of driven elements;

a plurality of actuators, each of said elements being driven by a pair of said actuators, one end of each of said actuators being connected to one of said elements;

a plurality of nuts, the other ends of each pair of said actuators being connected to a pair of said nuts;

a rotatable driving screw comprising a left side and a right side, one of said sides forming a threaded connection with its respective nuts and other side forming a sliding connection with its respective nuts, each pair of said nuts being movably installed on said left side and right side of said driving screw, said actuators being disposed at an angle relative to said driving screw, said actuators connected to elements to be driven a greater distance being longer and actuators connected to elements to be driven a shorter distance being shorter, whereby rotation of said driving screw causes each pair of said nuts to move along said driving screw in opposite directions causing said angle to change and causing elements connected to said longer actuators to travel a greater distance than elements connected to said shorter actuators.

* * * * *